US005256276A

United States Patent [19]

Weaver

[11] Patent Number: 5,256,276

[45] Date of Patent: Oct. 26, 1993

[54] METHOD FOR THE INHIBITION AND REMOVAL OF AMMONIUM CHLORIDE DEPOSITION IN HYDROCARBON PROCESSING UNITS BY ADDING LECITHIN

[75] Inventor: Carl E. Weaver, Conroe, Tex.

[73] Assignee: Betz Laboratories, Inc., Trevose, Pa.

[21] Appl. No.: 884,671

[22] Filed: May 18, 1992

[51] Int. Cl.[5] ..... C10G 9/16

[52] U.S. Cl. ..... 208/48 AA; 203/7

[58] Field of Search ..... 208/48 AA; 203/7

[56] References Cited

U.S. PATENT DOCUMENTS 4,024,050 5/1977 Shell et al. ..... 208/48 AA
4,490,275 12/1984 Niu ..... 252/189
4,793,865 12/1988 Staley et al. ..... 134/2

*Primary Examiner*—Theodore Morris
*Assistant Examiner*—Walter D. Griffin
*Attorney, Agent, or Firm*—Alexander D. Ricci; Gregory M. Hill

[57] ABSTRACT

A method for the inhibition and removal of ammonium chloride deposition in hydrocarbon processing units comprising adding a phosphatide to the hydrocarbon liquid. A preferred phosphatide is lecithin.

3 Claims, No Drawings

METHOD FOR THE INHIBITION AND REMOVAL OF AMMONIUM CHLORIDE DEPOSITION IN HYDROCARBON PROCESSING UNITS BY ADDING LECITHIN

FIELD OF THE INVENTION

The present invention relates to the field of hydrocarbon processing and specifically deals with the problems associated with the deposition of ammonium chloride salt crystals on metallic surfaces of the overhead equipment in elevated temperature processing units.

BACKGROUND OF THE INVENTION

A frequent source of operating problems in refining and hydrocarbon processing units is the formation of deposits throughout those units resulting in an increase in pressure drop, decrease in efficiency, increase in energy consumption, loss of operating time, and other well-known difficulties. These deposits include salts of ammonia, inorganic contaminants that enter the process in the feed, and deposits that develop as by-products from corrosion of the processing unit including metal sulfides, metal oxides, metal hydroxides, and other metal salts. These deposits alone or in combination with other hydrocarbon polymers and decomposition products often form deposits that are difficult to remove from the internals of the processing units.

During the processing of hydrocarbon liquids, such as crude oil, under the elevated temperature conditions of a refinery, small amounts of water emulsified or otherwise entrained in the hydrocarbon will first vaporize and then later condense on the metallic surfaces of the equipment overhead of high temperature units, such as distillation columns. This water contains acidic elements, predominantly hydrochloric acid (HCl), which will corrode the surfaces of the overhead equipment at locations where condensation occurs.

In an attempt to minimize this corrosion, hydrocarbon processors will add chemical compounds to the hydrocarbon prior to elevated temperature processing for the purpose of neutralizing the acid, e.g., HCl. The compound most frequently employed is ammonia. The ammonia will neutralize the HCl by forming ammonium chloride.

The neutralization of HCl by ammonia mitigates against the problems of corrosion but the formation of ammonium chloride causes others. The ammonium chloride, which is vaporized during elevated temperature processing, is sublimed onto the surfaces of the overhead equipment. Sublimation, as herein defined, is intended to mean that the ammonium chloride passes directly from the vapor state to its solid crystaline form, bypassing its liquid phase. Crystaline ammonium chloride builds up on these surfaces resulting in the operational problems previously discussed.

It is an object of the present invention to inhibit the growth of ammonium chloride deposits on the surfaces of the overhead equipment in a hydrocarbon refinery. The aforementioned problems are overcome by the present invention which discloses a method for the complete removal and/or prevention of the formation of deposits of ammonium chloride.

DETAILED DESCRIPTION OF THE INVENTION

The method of the present invention comprises adding to a hydrocarbon liquid prior to elevated temperature processing an amount of a phosphatide effective for the purpose of inhibiting the formation or providing for the removal of ammonium chloride deposits. The type of phosphatides within the purvue of this invention may be defined as being mixtures of diglycerides of fatty acids linked to the choline ester of phosphoric acid. The chemical formulation may be defined as having the following structure:

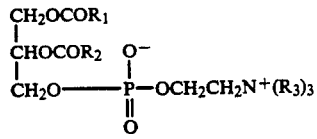

wherein $R_1$=$C_{10}$-$C_{30}$ alkyl, $R_2$=$C_{10}$-$C_{30}$ alkyl and $R_3$=$C_1$-$C_6$ alkyl Exemplary of those compounds is phosphatidyl choline, commonly referred to as lecithin. Lecithin is a by product in the manufacture of soybean oil and is characterized as having a quaternary amine group incorporated into a $C_{20}$-$C_{22}$ phospholipid. It is commercially available from Central Soya.

The phosphatide of the present invention may be utilized at a petroleum refinery experiencing ammonium chloride deposition problems. It may be added to the hydrocarbon liquid at any convenient location prior to the location or locations where elevated temperature processing of the hydrocarbon occurs and sublimation of ammonium chloride subsequently results. Suitable locations are within the crude unit distillation tower, into the trays within these towers, heat exchangers, receiving tanks, pump-rounds, overhead lines, reflux lines, connecting lines and the like.

The amount of the phosphatide compound that is required to achieve the desired objective of inhibiting or removing ammonium chloride deposition will vary and will depend upon the amount of ammonium chloride present in the hydrocarbon liquid prior to elevated temperature processing. The preferred method of determining the correct amount of phosphatide that must be added is by measuring the amount of ammonium chloride present in the hydrocarbon liquid. This may be accomplished by one of many well known means of analysis such as the phenate method for the determination of nitrogen, #417C from the Standard Methods for the Examination of Water and Wastewater, 16th Ed., pp 382-383, incorporated herein by reference. Thereafter, the moles of ammonium chloride present are determined by conventional calculation methods.

The amount of phosphatide necessary to achieve the objectives of the invention is a factor of the moles of ammonium chloride present in the hydrocarbon. This amount may be in the range of 1-10,000 ppm, by weight, based on the hydrocarbon liquid. Depending on the distinct design characteristics or operating conditions of the hydrocarbon processing unit to be treated, the amount of phosphatide to be added falls within the range of 1 to 10 moles of phosphatide per mole of ammonium chloride.

The phosphatide compound may be added to the hydrocarbon liquid either continuously or intermittently, as the processing unit design or operating conditions dictate. The compound may be added neat, or it may be dissolved as necessary in a suitable solvent.

EXAMPLE

A conventional laboratory reflux apparatus was employed to establish the efficacy of the present invention. The test consisted of heating to reflux for 4 hours 0.0025 mol of ammonium chloride in 100 ml of heavy aromatic naphtha (HAN) either with the treatment according to the invention, herein Lecithin, or without (blank). After the reflux period, the sublimed ammonium chloride was washed from the internal surface of the condenser with water. The amount of ammonium chloride sublimed on these surfaces was then determined by the phenate method for the determination of nitrogen, as defined above.

The amount of sublimed ammonium chloride according to the aforementioned test procedure is shown in Table 1, below.

TABLE I

| Amount of Ammonium Chloride Sublimed Expressed as a Percentage of The Initial Ammonium Chloride | | | |
|---|---|---|---|
| Treatment | Amount | Treatment:Ammonium Chloride (mole:mole) | % Ammonium Chloride Sublimed |
| Blank (mean) | — | — | 61+/−10* |
| Lecithin | 14.6 ppm | 1:1 | 26 |
| Lecithin | 14.6 | 1:1 | 21 |

*average of 10 runs.

The amount of ammonium chloride deposited on the internal surfaces of the reflux apparatus without treatment was approximately 61% of the total ammonium chloride added to the test apparatus prior to refluxing. The treatment with lecithin reduced by over 60% the amount of sublimed ammonium chloride.

The foregoing example is intended as being indicative of the efficacy of the invention. In no way should it be construed as limiting the scope of the invention as disclosed herein.

What I claim is:

1. A method for the inhibition of ammonium chloride deposition on the internal surfaces of a refinery processing hydrocarbon liquid to which ammonia has been added for the neutralizing of HCl comprising adding to the hydrocarbon liquid an effective ammonium chloride deposition inhibiting amount of lecithin having the formula:

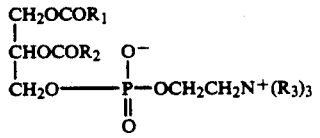

wherein $R_1$=$C_{10}$-$C_{30}$ alkyl, $R_2$=$C_{10}$-$C_{30}$ alkyl and $R_3$=$C_1$ alkyl.

2. The method of claim 1 wherein the amount of ammonium chloride present in the hydrocarbon liquid is initially determined by analysis of the hydrocarbon liquid.

3. The method of claim 2 wherein from 1 to 10 moles of lecithin is added to the hydrocarbon liquid per mole of ammonium chloride.

* * * * *